United States Patent [19]

Steward

[11] 4,304,559

[45] Dec. 8, 1981

[54] MARINE PROPELLER DEFOULING DEVICE

[75] Inventor: Aroney M. Steward, Pensacola, Fla.

[73] Assignee: Thomas Y. Awalt, Jr., Pensacola, Fla.

[21] Appl. No.: 123,114

[22] Filed: Feb. 21, 1980

[51] Int. Cl.[3] ..... B63B 35/08

[52] U.S. Cl. ..... 440/73

[58] Field of Search ..... 440/73; 56/8, 29, DIG. 19, 56/10.1, 12.7

[56] References Cited

U.S. PATENT DOCUMENTS 2,319,947 5/1943 Oswood ..... 440/73

4,233,735 11/1980 Tsuchiya ..... 56/12.7

*Primary Examiner*—Frank Sever

[57] ABSTRACT

Flexible linear members trail between the blades of a forward-moving marine shaft-driven propeller and impinge upon the blade surface to defoul the propeller blades.

7 Claims, 1 Drawing Figure

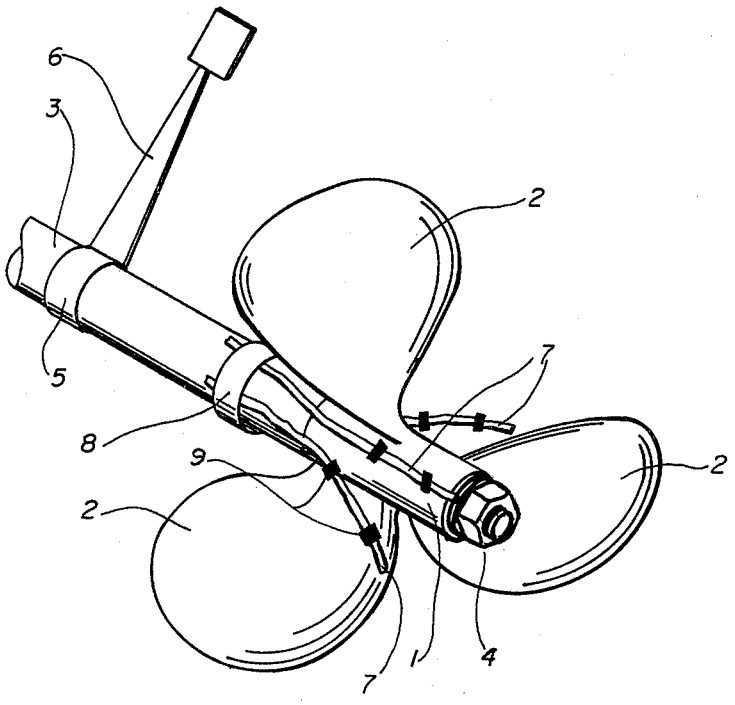
6
3
2
5
7
8
9
2
2
7
1
4

MARINE PROPELLER DEFOULING DEVICE

BACKGROUND OF THE INVENTION

A. Field of the Invention

The invention is a device for defouling marine propellers.

B. Description of the Invention

Fouling of underwater surfaces of boats has long been a problem which has not been entirely solved by the use of most modern anti-fouling paints. These paints tend to lose their toxicity on contact with most propellers which are made of copper-containing alloys such as bronze. In salt water, formation of barnacles is rapid, and is not prevented or substantially deterred by intermittent use of the propellers.

SUMMARY OF THE INVENTION

The invention is a device comprising at least one and preferably a plurality of linear members having a trailing flexible blade unpinging portion which are mounted in such a manner that the trailing portion trails in the turbulent interblade spaces when the propeller is in forward motion. A forward holding portion of the linear member is secured or mounted in fixed relationship to the shaft, on the shaft forward of the propeller or on the forward stock of the propeller.

Reference will be made to the drawing in which the FIGURE is a perspective view of a preferred embodiment of the invention.

DETAILED DESCRIPTION OF THE INVENTION

Referring to the drawing, the FIGURE shows a preferred embodiment. Propeller hub 1 with blades 2 turns on shaft 3 and is held thereon by lock nut 4. Shaft 3 is supported by strut 6, turning in bearing 5. Attached to shaft 3 in accordance with this invention is clamp 8 which holds in place the holding portion of linear member 7. The trailing flexible blade impinging portion of linear member 7 has attached thereto optional blade impinging weights 9.

When the propeller is in the forward motion, the trailing portion of linear member 7 and weights 9 impinge against the working surfaces of blades 2 dislodging foreign materials including embryo barnacles.

The linear member may be flexible in its entirety or it may have an inflexible forward holding portion. It is preferably a stainless steel wire or braid. Mounting means for the holding portion may be any conventional clamp or a mount permanently or semi-permanently affixed to the shaft or to the leading end of the propeller hub.

Although not required, superior results may be obtained when used with slow moving propellers if weights are attached to the flexible trailing portion of the linear member.

I claim:

1. A device for defouling and the prevention of fouling of a marine shaft-drive propeller having a plurality of blades and turbulent interblade spaces while the propeller is in motion comprising in combination:

(a) means for disloding foreign materials which may otherwise form on the surfaces of said blades and thereby maintaining the efficiency of said propeller, including, at least one linear member having a forward holding portion and a trailing flexible blade-impinging portion, and (b) means for mounting the forward holding portion of the linear members forward of the propeller and in fixed relation to the shaft and the propeller whereby the trailing flexible blade-impinging portion of the linear member will be located so as to flexibly trail into a turbulent interblade space while the propeller is in forward motion, so flexing in the turbulence as to repeatedly impinge upon a substantial area of at least one propeller blade.

2. The device of claim 1 comprising a plurality of linear members.

3. The device of claim 1 comprising at least one linear member for each interblade space.

4. The device of claim 1 wherein the linear member is a metal wire.

5. The device of claim 1 wherein the linear member is a metallic braid.

6. The device of claim 1 wherein the linear member has attached to the flexible blade-impinging portion blade impinging weights.

7. The device of claim 1 wherein the mounting means comprises a shaft-mountable clamp.

* * * * *